US010400550B2

(12) United States Patent
Gu et al.

(10) Patent No.: US 10,400,550 B2
(45) Date of Patent: Sep. 3, 2019

(54) SHALE FRACTURING CHARACTERIZATION AND OPTIMIZATION USING THREE-DIMENSIONAL FRACTURE MODELING AND NEURAL NETWORK

(71) Applicant: HALLIBURTON ENERGY SERVICES, INC., Houston, TX (US)

(72) Inventors: Ming Gu, Humble, TX (US); Deepak Gokaraju, Humble, TX (US); John Andrew Quirein, Georgetown, TX (US); Dingding Chen, Tomball, TX (US)

(73) Assignee: Halliburton Energy Services, Inc., Houston ( * ) Notice: Subject to any disclaimer, the term of this patent is extended or adjusted under 35 U.S.C. 154(b) by 119 days.

(21) Appl. No.: 15/505,576

(22) PCT Filed: Sep. 2, 2015

(86) PCT No.: PCT/US2015/048120
§ 371 (c)(1),
(2) Date: Feb. 21, 2017

(87) PCT Pub. No.: WO2016/064476
PCT Pub. Date: Apr. 28, 2016

(65) Prior Publication Data
US 2018/0216441 A1 Aug. 2, 2018

Related U.S. Application Data

(60) Provisional application No. 62/068,249, filed on Oct. 24, 2014.

(51) Int. Cl.
*E21B 41/00* (2006.01)
*E21B 43/26* (2006.01)

(52) U.S. Cl.
CPC ..... *E21B 41/0092* (2013.01); *E21B 43/26* (2013.01); *E21B 2041/0028* (2013.01)

(58) Field of Classification Search
CPC ..... E21B 41/0092; E21B 43/26; E21B 2041/0028
(Continued)

(56) References Cited

U.S. PATENT DOCUMENTS 5,205,164 A 4/1993 Steiger et al.
2008/0183451 A1 7/2008 Weng et al.
(Continued)

FOREIGN PATENT DOCUMENTS

EP 2497900 A2 9/2012

OTHER PUBLICATIONS

Michael Schoenberg, Francis Muir and Colin Sayers, Introducing Annie: A Simple Three-Parameter Anisotropic Velocity Model for Shales, Oct. 24, 1995, 15 pages, Journal of Seismic Exploration 5, Geophysical Press Ltd.
(Continued)

*Primary Examiner* — Saif A Alhija

(57) ABSTRACT

A method for shale fracturing includes determining dynamic-elastic properties of a shale deposit in a geological formation. A training database is generated by three-dimensional fracture modeling. A neural network is generated in response to output results of the training database. The shale fracturing may then be performed based on the neural network.

19 Claims, 12 Drawing Sheets

(58) Field of Classification Search
USPC ..... 703/10
See application file for complete search history.

(56) References Cited

U.S. PATENT DOCUMENTS

| | | | | |
|---|---|---|---|---|
| 2010/0312534 | A1 | 12/2010 | Xu et al. | |
| 2011/0257944 | A1* | 10/2011 | Du | E21B 43/267 703/2 |
| 2012/0185225 | A1 | 7/2012 | Onda et al. | |
| 2013/0270011 | A1 | 10/2013 | Akkurt et al. | |
| 2014/0067353 | A1 | 3/2014 | Shelley et al. | |

OTHER PUBLICATIONS

S. A. Khristianovic and Y. P. Zheltov, Formation of Vertical Fractures by Means of Highly Viscous Liquid, 1955, 8 pages, Proceedings Fourth World Petroleum Congress-Section II T.O.P., Rome, Italy.

M. Chertov, Closed-form Solution for Vertical Fracture Width in Anisotropic Elastic Formations, International Journal of Rock Mechanics & Mining Sciences, Apr. 13, 2012, 6 pages, vol. 53, Elsevier Ltd., Salt Lake City, Utah, USA.

I. N. Sneddon and D.S. Berry, The Classical Theory of Elasticity, 1958, 126 pages, Berlin: Springer-Verlag.

Hongren Gu and K.H. Leung, 3D Numerical Simulation of Hydraulic Fracture Closure With Application to Minifracture Analysis, Society of Petroleum Engineers, Mar. 1993, 7 pages, Journal of Petroleum Technology.

T.K. Perkins and L.R. Kern, Widths of Hydraulic Fractures, Sep. 1961, 13 pages, Journal of Petroleum Technology, SPE 89, 36$^{th}$ Annual Fall Meeting of SPE, Oct. 8-11, 1961, Dallas, Texas.

R. P. Nordgren, Propagation of a Vertical Hydraulic Fracture, Aug. 1972, 9 pages, Society of Petroleum Engineers Journal, SPE 3009, SPE 45$^{th}$ Annual Fall Meeting, Oct. 4-7, 1970, Houston, Texas.

John Quirein, Mahmoud Eid and Arthur Cheng, Predicting the Stiffness Tensor of a Transversely Isotropic Medium When the Vertical Poisson's Ratio is Less Than the Horizontal Poisson's Ratio, May 18-22, 2014, 11 pages, SPWLA 55$^{TH}$ Annual Logging Symposium, Abu Dhabi, United Arab Emirates.

J. L. Sousa, B. J. Carter and A.R. Ingraffea, Numerical Simulation of 3D Hydraulic Fracture Using Newtonian and Power-Law Fluids, 1993, 7 pages, Int. J. Rock Mech. Min. Sci & Geomech Abstr. vol. 30, No. 7, Great Britain.

J. Geerstma and F. De Klerk, A Rapid Method of Predicting Width and Extent of Hydraulically Induced Fractures, Dec. 1969, 11 pages, Journal of Petroleum Technology.

Kyle Friehauf and Mukul. M. Sharma, A New Compositional Model for Hydraulic Fracturing With Energized Fluids, Sep. 21-24, 2008, 16 pages, SPE 115750, 2008 SPE Annual Technical Conference and Exhibition, Society of Petroleum Engineers, Denver, Colorado.

C. Cipolla, X. Weng, H. Onda, T. Nadaraja, U. Ganguly and R. Malpani, New Algorithms and Integrated Workflow for Tight Gas and Shale Completions, Oct. 30-Nov. 2, 2011, 18 pages, SPE 146872, SPE Annual Technical Conference and Exhibition, Society of Petroleum Engineers, Denver, Colorado.

Shannon Higgins, Scott Goodwin, Adam Donald, Tom Bratton and George Tracy, Anisotropic Stress Models Improve Completion Design in the Baxter Shale, Sep. 21-24, 2008, 10 pages, SPE 115736, 2008 SPE Annual Technical Conference and Exhibition, Society of Petroleum Engineers, Denver, Colorado.

Ming Gu, Pandurang Kulkarni, Mehdi Rafiee, Endre Ivarrud and Kishore Mohanty, Understanding the Optimum Fracture Conductivity for Naturally Fractured Shale and Tight Reservoirs, Sep. 30-Oct. 2, 2014, 18 pages, SPE 171648-MS, SPE/CSUR Unconventional Resources Conference, Society of Petroleum Engineers, Calgary, Alberta Canada.

Paul Huckabee, Minquan Jin, Robert Lund, Dave Nasse and Kristin Williams, Tight Gas Well Performance Evaluation With Neural Network, Analysis for Hydraulic Propped Fracture Treatment Optimization, Society of Petroleum Engineers, Sep. 19-22, 2010, 1-30 pages, SPE 135523, SPE Annual Technical Conference and Exhibition, Florence, Italy.

C. E. Cohen, C. Abad, X. Weng, K. England, A. Phatak, O. Kresse, O. Nevvonen, V. Lafitte and P. Abivin, Optimum Fluid and Proppant Selection for Hydraulic Fracturing in Shale Gas Reservoirs: a Parametric Study Based on Fracturing-to-Production Simulations, Feb. 4-6, 2013, 1-18 pages, SPE 163876, SPE Hydraulic Fracturing Technology Conference, Society of Petroleum Engineers, Woodlands, Texas.

Korean Intellectual Property Office, International Search Report and Written Opinion, dated Dec. 16, 2015, 12 pages, Korea.

* cited by examiner

SHALE FRACTURING CHARACTERIZATION AND OPTIMIZATION USING THREE-DIMENSIONAL FRACTURE MODELING AND NEURAL NETWORK

CLAIM OF PRIORITY

The present application is a U.S. National Stage patent application of International Patent Application No. PCT/US2015/048120, filed on Sep. 2, 2015, which claims the benefit of priority to provisional application Ser. No. 62/068,249, filed Oct. 24, 2014, both of which are incorporated herein by reference in their entireties.

BACKGROUND

The laminated nature of shale and tight geological formations may lead to different mechanical properties along the vertical and horizontal directions. The anisotropy of elastic rock behavior and the resulting complex closure stress profile induce difficulties to characterize fracture geometries and locations. The effective propped area (EPA) of highly laminated anisotropic reservoirs may dominate both short- and long-term fracture production performance. The EPA may be sensitive to perforation positions and other completion parameters such as injection rate, injection volume, fluid viscosity, and proppant concentration. As a result, it may be difficult to determine optimum completion strategies of shale formations based on current analytical models or a limited number of numerical modeling cases.

DETAILED DESCRIPTION

The method for shale fracturing characterization and optimization may provide a more efficient way to predict hydraulic fracture geometry (length, height and width) and vertical location in shale and tight reservoirs. The embodiments may be used to generate a sensitivity study for finding "sweet spots" in shale deposits to place perforation clusters and select optimal hydraulic fracturing parameters to produce the best fracture productivity and net present value (NPV) along wellbores (e.g., vertical, horizontal, slant).

Figure 1:
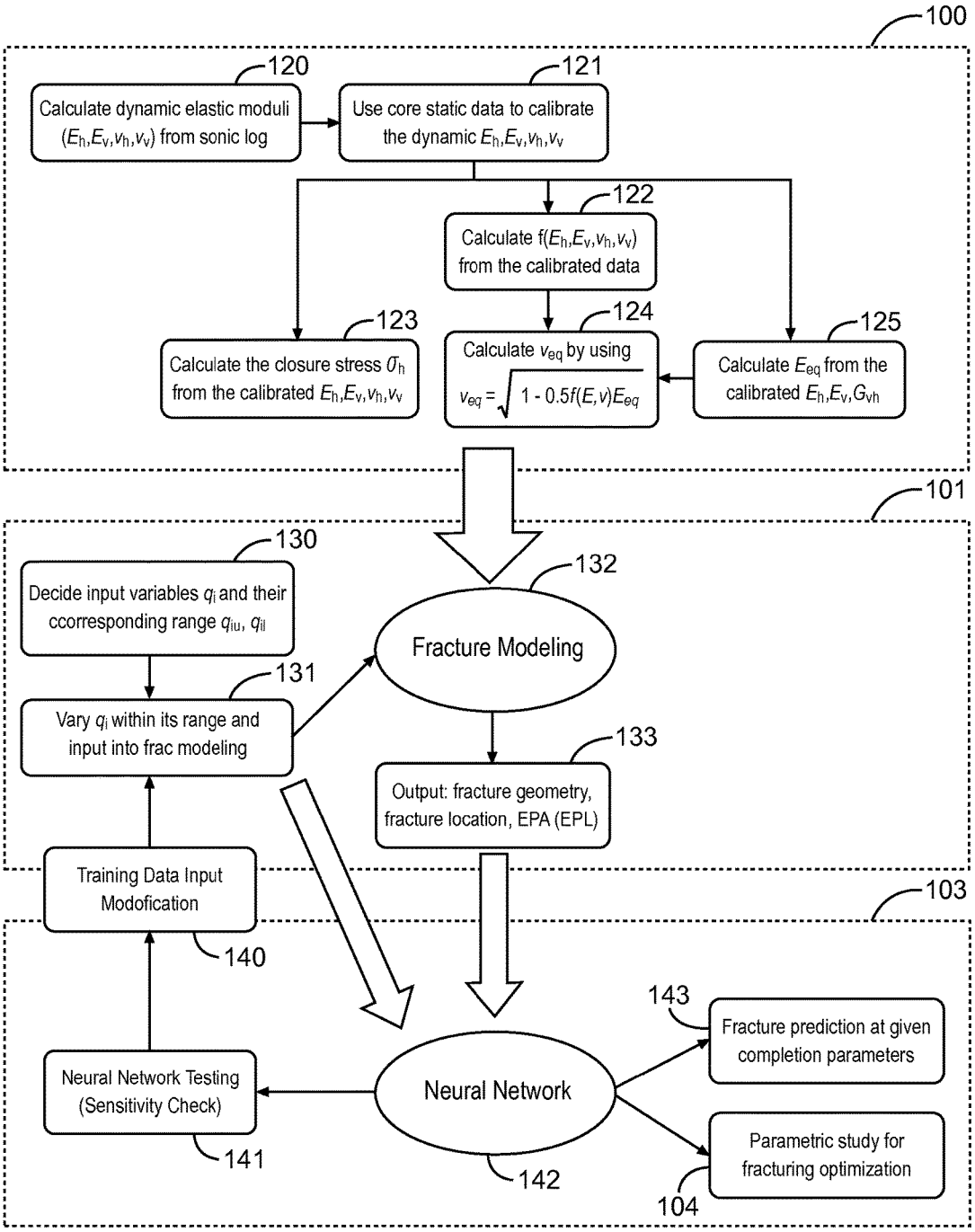
FIG. 1 is a flowchart showing an embodiment of a method for shale fracturing characterization and optimization, according to various embodiments.

The work flow of the method, as illustrated in FIG. 1, combines log interpretation, fracture modeling, neural networks, and a parametric study. In the first three steps of the workflow, fracture dimensions and positions can be relatively quickly and accurately predicted for any given completion parameter inputs. The fourth step (parametric study) determines the effective propped area/length and fracture upper/lower boundary as a correlation of the perforation position and other completion parameters. Thus, the optimum completion strategy may be determined to produce the largest EPA for target reservoirs. The parametric study results may be combined with reservoir simulation and NPV analysis to further optimize the well NPV.

The subsequently disclosed equations may be used in one or more of the steps of FIG. 1. For isotropic formations, Eq. (1) may be used to estimate fracture width, assuming an elliptical contained fracture:

$$w(x, t) = \frac{2 - 2\nu^2}{E} h\sigma_{net}(x, t) \tag{1}$$

In the equation above, w is the maximum fracture width in the center of the elliptical cross-section, h is fracture height, $\sigma_{net}$ is net pressure (fracture pressure minus closure stress), E and ν are the isotropic Young's Modulus and Poisson's ratio, which are usually measured by slowness of compressional and shear waves transported vertically.

For transversely isotropic formations with a vertical axis (TIV), such as shale, a closed-form analytical solution may be expressed as:

$$w(x, t) = \sqrt{\frac{1 - \nu_h^2}{2G_{vh}E_h}} \left[ \sqrt{\left(1 - \frac{2G_{vh}}{E_v}(1 + \nu_h)\nu_v\right) - \sqrt{1 - \frac{4G_{vh}}{E_v}(1 + \nu_h)\nu_v - \frac{4G_{vh}^2}{E_vE_h}(1 + \nu_h)\left(1 - \nu_h - 2\frac{E_h}{E_v}\nu_v^2\right)}} + \sqrt{\left(1 - \frac{2G_{vh}}{E_v}(1 + \nu_h)\nu_v\right) + \sqrt{1 - \frac{4G_{vh}}{E_v}(1 + \nu_h)\nu_v - \frac{4G_{vh}^2}{E_vE_h}(1 + \nu_h)\left(1 - \nu_h - 2\frac{E_h}{E_v}\nu_v^2\right)}} \right] h\sigma_{net}(x, t) \tag{2}$$

where $E_h$ and $E_v$ are horizontal and vertical Young's Modulus, $\nu_h$ and $\nu_v$ are horizontal and vertical Poisson's ratio, and $G_{vh}$ is the shear Modulus in the x-z plane. The two equations take the similar form with the only difference of the elastic property term $f(E,\nu)=w/h/\sigma_{net}$. Compared with the isotropic equation, the anisotropic equation has a much more complicated $f(E,\nu)$, which takes into account both horizontal and vertical elastic moduli. The horizontal and vertical elastic moduli can be calculated with an ANNIE model combined with additionally measured Stonley wave (horizontally transported shear wave approximation). ANNIE is a widely-used anisotropic velocity model for shale interpretation. ANNIE may be modified to predict $\nu_h>\nu_v$ and to better predict anisotropic stress.

The analytical equations above are only used for calculating static fracture width under known net pressure and fracture height. For calculating a propagating hydraulic fracture, Eq. (1) or (2) is combined with the mass balance equation and fluid flow equation. By assuming different fracture shapes, different two-dimensional fracture propagation models were developed. One example of a model is Perkins, Kern & Nordgren (PKN) which assumes an elliptical cross section with a fixed fracture height. Another example of a model is Khristianovitch-Geertsma-de. Klerk (GDK), which assumes a rectangular cross section with a fixed fracture height and an elliptical shape in the horizontal plane. Eq. (3)~(5) are analytical solutions given by PKN without considering leak-off.

$$w(0,t)=c_w\left[\frac{f(E,\nu)q_0^2\mu}{h}\right]^{\frac{1}{5}}t^{\frac{1}{5}} \tag{3}$$

$$L(t)=c_l\left[\frac{q_0^3}{f(E,\nu)\mu h^4}\right]^{\frac{1}{5}}t^{\frac{4}{5}} \tag{4}$$

$$\sigma_{net}(0,t)=c_w\left[\frac{q_0^2\mu}{f(E,\nu)^4h^6}\right]^{\frac{1}{5}}t^{\frac{1}{5}} \tag{5}$$

In the equation system above, $f(E,\nu)$ is the elastic property term of either Eq. (1) or Eq. (2) depending on the rock type, $q_0$ is the injection rate, $\mu$ is the fracturing fluid viscosity, h is the fracture height, t is the injection time, and $c_w$, $c_l$ are unit conversion coefficients. The two-dimensional (2D) analytical models illustrate the impact of elastic properties and completion parameters on fracture geometries but they assume fixed fracture height and constant elastic properties along the height, which is not generally valid for laminated shale reservoirs. Additionally it can be shown that, even for a perfectly contained fracture scenario with a fixed height, PKN and KGD may underestimate the net pressure, which results in a much larger fracture length and smaller fracture width. Another important reason for limiting the use of 2D analytical models in unconventional reservoirs is that they cannot simulate proppant settling. This may be important in slick water treatment and may impact the final fracture productivity.

To simulate propagations of fractures of arbitrary shape and orientation along with proppant transport in a multi-layer reservoir such as shale, numerical simulations are conducted by solving a set of coupled equations governing deformation of a three-dimensional (3D) rock and 2D fluid/solid particle flow inside the fracture. They are mathematically more rigorous but expensive to run, especially for parametric studies handling a large amount of input parameter combinations. The computation time for a 3D finite element or finite difference model depends on the number of fractures, pump schedules (simulation scale), complexity of stress layers (number of layers) and grid number (simulation accuracy). Compared with conventional reservoirs, unconventional reservoirs have more complex anisotropy layers and require horizontal drilling with multiple fracture stages. 3D fracture modeling simulator computation time may typically increase going from conventional reservoirs to unconventional reservoirs. Examples of 3D fracture modeling simulators include StimPlan™, FracPro®, MFrac™, UTFrac™ and Gohfer®. These simulators use isotropic elastic rock models.

Embodiments of the present method may be used to quickly and accurately predict hydraulic fracture geometry (length, height and width), effective propped area/length, fracture upper/lower boundaries, and position for both isotropic and anisotropic unconventional reservoirs for any given completion parameters (perforation position, injection rate, injection time etc.). The method may also be used to generate a massive sensitivity study within a short time for finding "sweet spots" to put perforation clusters along horizontal or vertical wells and selecting optimal hydraulic fracturing parameters to produce the largest EPA (short-term production) or stimulated reservoir volume (SRV) (long-term production). For a planar fracture scenario with fixed fracture spacing and a fully propped pay interval, both EPA and SRV can be reduced to effective propped length (EPL). The sensitivity study results can further be combined with reservoir simulation to optimize the total fractured well NPV.

FIG. 1 is a flowchart showing an embodiment of a method for shale fracturing characterization and optimization, according to various embodiments. The workflow is divided up into four main steps 100-104 after well log sonic data is obtained as discussed subsequently with reference to the systems of FIGS. 10 and 11. In the first step 100, the horizontal and vertical dynamic elastic properties ($E_h$, $E_v$, $\nu_h$, $\nu_v$) are interpreted by a model (e.g., modified ANNIE) in conjunction with the well log sonic data (Eqs. 6-7) in block 120.

$$\begin{cases} E_{vert}=C_{33}-\dfrac{2C_{13}^2}{C_{11}+C_{12}} \\ E_{horz}=C_{11}+\dfrac{C_{13}^2(C_{12}-C_{11})+C_{12}(C_{13}^2-C_{12}*C_{33})}{C_{33}*C_{11}-C_{13}^2} \end{cases} \tag{6}$$

$$\begin{cases} \upsilon_{horz}=\dfrac{C_{33}C_{12}-C_{13}^2}{C_{33}C_{11}-C_{13}^2} \\ \upsilon_{vert}=\dfrac{C_{13}}{C_{11}+C_{12}} \end{cases} \tag{7}$$

where $C_{ij}$ is the stiffness coefficient. For a vertical well, $C_{33}$, $C_{44}$ and $C_{66}$ are determined by P-, S- and Stonely-wave, respectively. In the ANNIE model, $C_{13}=C_{33}-2C_{44}$, obtained from the ANNIE assumption: Thomsen parameter $\delta=0$. $C_{12}=C_{13}$, which is based on observation. Finally, $C_{11}$ is obtained by symmetry constraint: $2C_{66}+C_{12}$. In modified ANNIE, $C_{11}=k'(2(C_{66}-C_{44})+C_{33})$. According to symmetry constrain, $C_{12}=C_{11}-2C_{66}$. Finally, $C_{13}=kC_{12}$. Both k' and k are determined by core data regression.

The dynamic $E_h$, $E_v$, $\nu_h$, $\nu_v$ are then calibrated, in block 121, by the static core data. The calibrated elastic properties are substituted in Eq. (2) to calculate $f(E_h, E_v, \nu_h, \nu_v)$ in block 122. In order to convert the four anisotropic elastic properties ($E_h$, $E_v$, $\nu_h$, $\nu_v$) interpreted from the log data into the two equivalent isotropic properties to be utilized by one of the commercially available fracture modeling simulator, a two-step procedure is conducted. In block 125, an equivalent Young's Modulus $E_{eq}$ can be calculated by $a_hE_h+a_vE_v+2a_{vh}G_{vh}(1+\nu_{vh})$. In this calculation, $\nu_{vh}$ is the arithmetic averaging for $\nu_v$ and $\nu_h$ and $a_i$ is the weight coefficient from 0 to 1 ($a_h+a_v+a_{vh}=1$). Based on the calculated $f(E_h, E_v, \nu_h, \nu_v)$ and $E_{eq}$, an equivalent Poisson's ratio $\nu_{eq}$ can be calculated by Eq. (8) in block 124.

$$\nu_{eq} = \sqrt{1 - \frac{f(E_h, E_v, \nu_h, \nu_v)E_{eq}}{2}} \tag{8}$$

For a TIV medium, the anisotropic stress $\sigma_h$ is given by:

$$\sigma_h = \frac{E_h\nu_v}{E_v(1-\nu_h)}[\sigma_v - \alpha P_p] + \alpha P_p + \frac{E_h}{1-\nu_h^2}\varepsilon_h + \frac{E_h\nu_h}{1-\nu_h^2}\varepsilon_H \tag{9}$$

where $\alpha$ is Biot's coefficient, $P_p$ is pore pressure, $\varepsilon_h$ is minimum tectonic strain, and $\varepsilon_H$ is maximum tectonic strain. The workflow is designed for a transversely isotropic medium with a vertical symmetry axis (i.e., a TIV medium). For an isotropic formation, all the steps are still established. When $E_h=E_v$, $\nu_h=\nu_v$, Eqs. 6, 7 and 9 reduce to the isotropic equations, and $E_{eq}$ and $\nu_{eq}$ reduce to $E_{iso}$ and $\nu_{iso}$. In block 123, the closure stress $\sigma_h$ is calculated based on the dynamic $E_h$, $E_v$, $\nu_h$, $\nu_v$ calibrated by core data.

In the second step 101, the rock mechanical properties ($E_{eq}$, $\nu_{eq}$) and the closure stress $\sigma_h$ from the first step 100 are input into a 3D fracture modeling simulator 132. In block 130, completion parameters $q_i$, such as slurry injection rate ($q_{inj}$), total slurry volume ($q_{tot}$), and the perforation depth ($TVD_{perf}$), are determined. Also in block 130, each completion parameter's corresponding range $q_{iu}$, $q_{il}$ (i.e., $q_{iu}$=upper limit; $q_{il}$=lower limit) are determined. In block 131, the completion parameters $q_i$ are varied and input into fracture modeling to get the corresponding outputs. The output results 133 of the training database include fracture geometry (e.g., fracture length ($L_f$), height ($H_f$), width ($w_f$)), effective propped area (EPA) and length (EPL) ($L_{eff}$) (EPA), and fracture upper/lower boundary. The inputs and outputs are then used to train the neural network 142 in block 103.

To improve the computational efficiency by reducing the number of fracture modeling cases, a recirculating loop (including blocks 131, 132, 133, 140, 141, 142) is formed between the second step 101 and the third step 103. To generate an initial training data base, each completion parameter is varied by a plurality of values (e.g., three) that are equally distributed within an interested range of values (e.g., $q_{iu}$, $q_{il}$). If there are n parameters, the total number of training data samples is $3^n$.

Once the neural network 142 is generated, a group of testing data is run to check the relative error of the outputs for each input parameter. For any input parameter, if the tolerance relative error is not met between Node_i and Node_i+1, one more data point Node_i+½ is added in between. The extra cases regarding the added data point are run in fracture modeling 132 to update the current training data base, and further update the neural network 142. Testing is run on the new neural network 142. If the tolerance error is met for all input parameters, the loop is stopped. Otherwise, the loop is repeated until the criterion is met (i.e., tolerance error is less than a predetermined threshold).

Once the neural network 142 is trained, the fracture geometry and location, based on the input of arbitrary completion values, may be predicted at block 143. In another embodiment, the fracturing design may be optimized by conducting a parametric study with the neural network in block 104.

The effective propped length (EPL) may be used as a possible candidate for an optimization target, among all the predicted outputs, for fracturing optimization. It is the propped length within the pay zone (i.e., highest concentration of TOC) occupied by infinite relative conductivity: Fracture conductivity/(propped fracture length*matrix permeability)>z, where z is a constant (e.g., 50 for conventionals). The constant z for shale may be some other value determined by empirical experimentation or reservoir simulation.

The EPL dominates the short-term production and affects the long-term production. For better optimization, a critical conductivity may be used instead of the infinite relative conductivity in order to define the EPL. The critical conductivity is defined as the minimum conductivity needed for fully stimulating a certain propped length during a certain production time. It is a function of propped length, production time, matrix permeability, natural fracture properties, oil API and other completion and production parameters.

Figure 2:
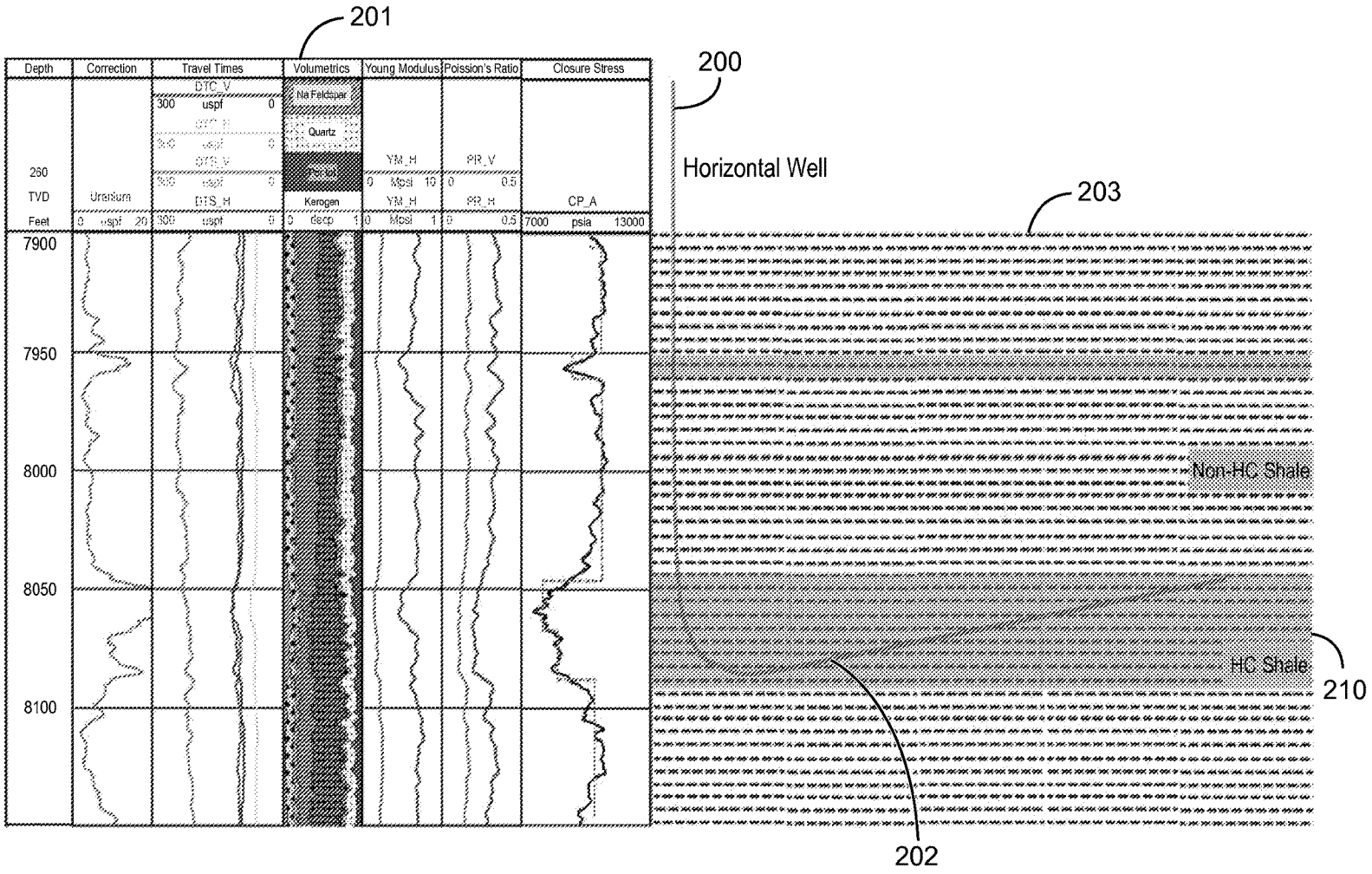
FIG. 2 is a plot showing an interpreted log of a shale reservoir, according to various embodiments.

The results of the method of FIG. 1, as applied to an actual field case, are illustrated in FIGS. 2-9 and discussed subsequently. FIG. 2 is a plot showing an interpreted log 201 of a shale reservoir 210 in a geological formation 203, according to various embodiments. From left to right, the tracks show depth, uranium concentration, sonic wave slowness, mineral volumetrics, Young's Modulus, Poisson's Ratio and closure stress. The log interpreted results are calibrated to core data. According to the log 201, the formation 203 includes a five-bedding-layer case with an upper pay, a lower pay and three stress boundary layers. A horizontal well 200 with a toe-up lateral part 202 staying within the lower pay 210.

In this case, the shale formation is a TIV medium with horizontal Poisson's Ratio>vertical Poisson's Ratio. The modified ANNIE model may be applied to interpret the horizontal and vertical elastic properties. The results are shown in the $5^{th}$ and $6^{th}$ track of FIG. 2. Based on the elastic properties, Eq. (9) may be used to calculate the closure stress, which is shown in the last track of FIG. 2. To convert the four anisotropic elastic properties to two equivalent isotropic properties, the elastic moduli function $f(E,\nu)$ is calculated by Eq. (2). This conversion is only used with a 3D isotropic simulator. No conversion is used with anisotropic 3D simulators. The equivalent Young's Modulus $E_{eq}$ is calculated by $[E_h+E_v+G_{vh}(2+2\nu_{vh})]/3$. Substituting $f(E,\nu)$ and $E_{eq}$ into Eq. (8), the equivalent Poisson's Ratio $\nu_{eq}$ is obtained. The results of anisotropic Young's Modulus and Poisson's Ratio, the $f(E,\nu)$ value, and the equivalent isotropic Young's Modulus and Poisson's Ratio are shown in FIG. 3.

Figure 3:
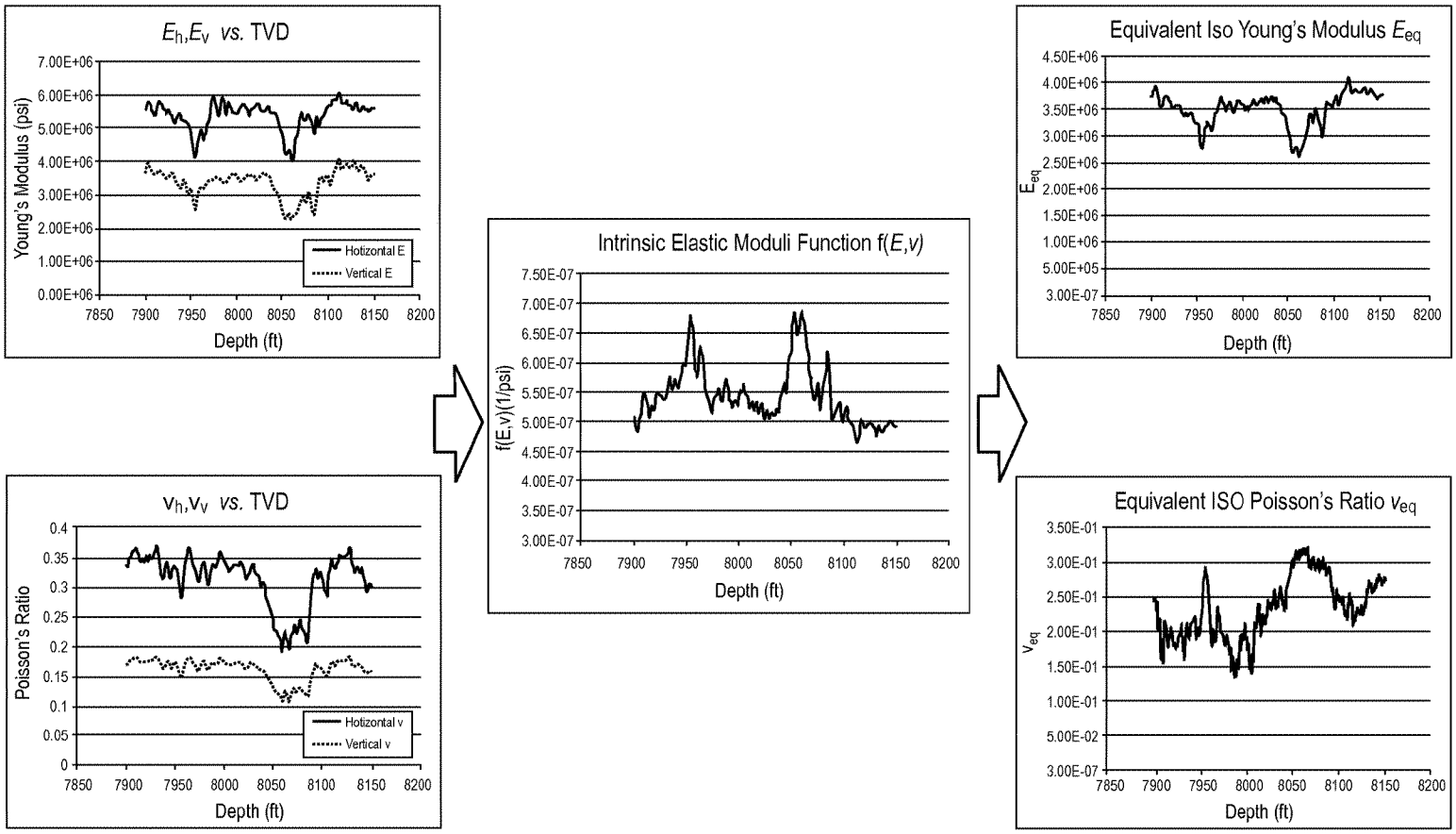
FIG. 3 is a plurality of plots showing calculation of equivalent isotropic elastic moduli for input to a fracture modeling simulator using an isotropic elastic rock model, according to various embodiments.

FIG. 3 is a plurality of plots showing calculation of equivalent isotropic elastic moduli for input to an isotropic fracture modeling simulator, according to various embodiments. The method for calculating the equivalent isotropic elastic properties is based on the fact that the fracture shape predicted by a current state-of-the-art fracture simulator is affected by the combination of E and $\nu$ as $f(E,\nu)$ instead of the individual E and $\nu$. This can be observed from Eqs. (3)-(5). It is also proved by running different cases with the same $f(E,\nu)$ in the fracture simulator. Different values of E and $\nu$ yield the same fracture geometries and net pressure histories if $f(E,\nu)$ is the same. This method can be a good approximation for simple scenarios where rock deformation is linear-elastic and no stress interference is considered.

Figure 4:
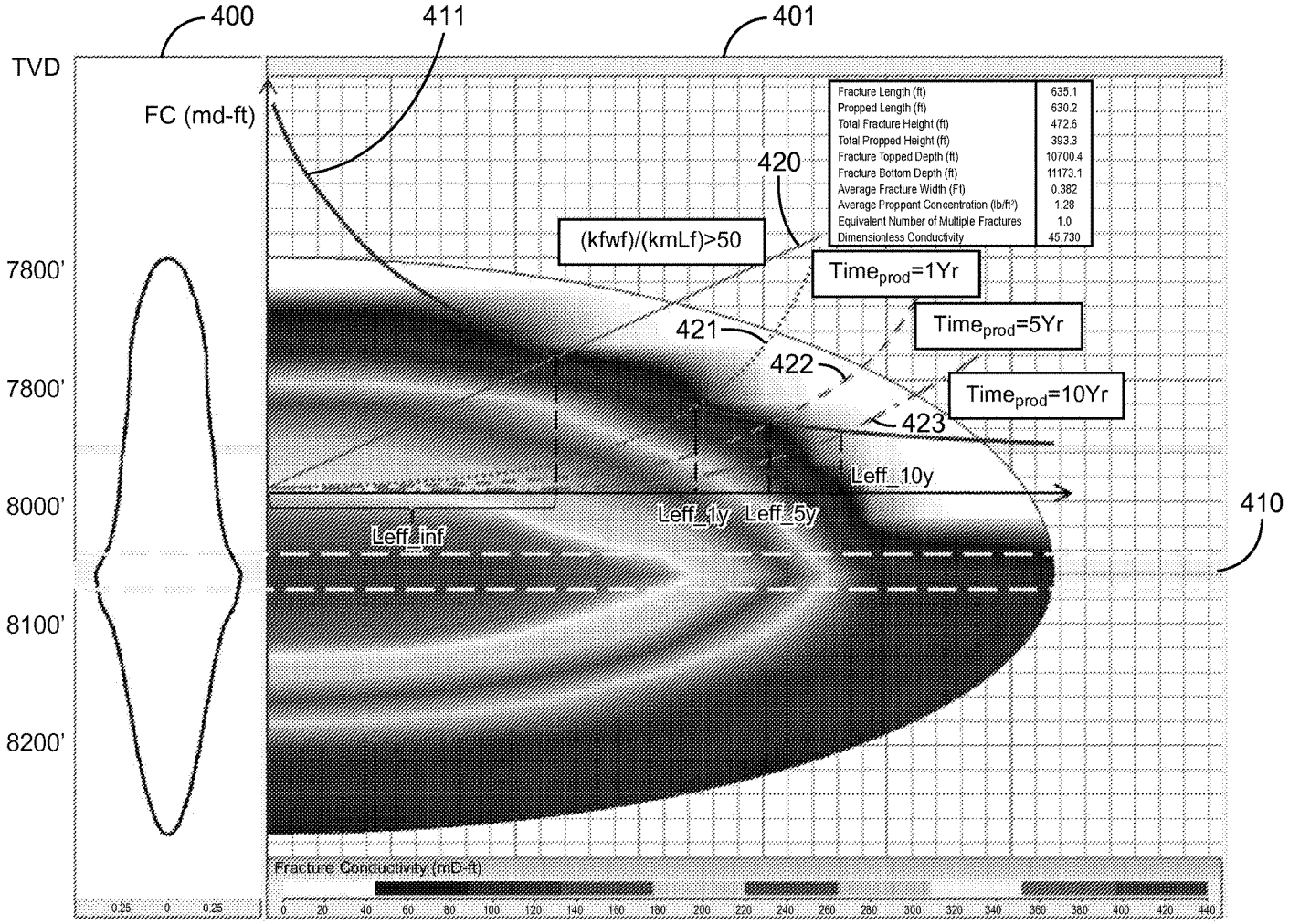
FIG. 4 is a plot of fracture geometry, location, and effective propped length as generated by the fracture modeling simulator, according to various embodiments.

The calculated equivalent isotropic properties and closure stress are input into the 3D fracture modeling simulator to predict the fracture geometry, fracture location, and proppant (conductivity) distribution. FIG. 4 illustrates an example result.

FIG. 4 is a plot of fracture geometry, location, and effective propped length as generated by the fracture modeling simulator, according to various embodiments. The left track 400 shows the fracture width-height cross section, while the right track 401 shows the length-height cross section. The shaded contour represents the conductivity distribution. Only the conductivity distribution within the pay zone 410 governs the fracture productivity. The fracture conductivity decreases with increasing propped length as shown by line 411. In the same plot, the minimum conductivity required to fully stimulate different propped length is shown by lines 420-423. The top line 420 is based on the assumption of transient flow. The dotted line 421, dashed line 422, and dot-dash line 423 are minimum conductivity criteria regarding 1-, 5- and 10-year production time, respectively (considering drainage boundary effect). The cross points for line 411 and the other lines 421-423 are EPLs based on different production time. For a certain production time, the larger the EPL, the better the fracture productivity. So the EPLs may be good candidates for fracturing optimization. In this study, a single fracture within an infinite reservoir is assumed. Thus, $L_{eff_inf}$ is adopted as an optimization target in a later analysis.

The presently discussed embodiment uses three input completion parameters: slurry injection rate, total injection volume, and perforation position along the horizontal well. The horizontal position is correlated with depth based on geosteering data. Five output results are fracture length, fracture height, fracture width, upper and lower depth of fracture, and effective propped length. Other embodiments may use different completion parameters and/or different output results.

As discussed previously with reference to FIG. 1, the output results from the 3D fracture modeling simulator 132 and its corresponding inputs 131 are further delivered to the neural network 142 for neural network training. In an embodiment, the neural network may have two hidden layers and one output layer. Starting with 27 training cases (variation by three values for each of three input completion parameters), the loop is circulated to improve the neural network accuracy by enlarging the training data base after each iteration. There is no requirement that each completion parameter be varied the same number of times as the remaining parameters. For example, one neural network may be obtained from 70 training cases database that is composed by varying the injection rate by three values, injection volume by five values, and perforation position by four values.

Figure 5:
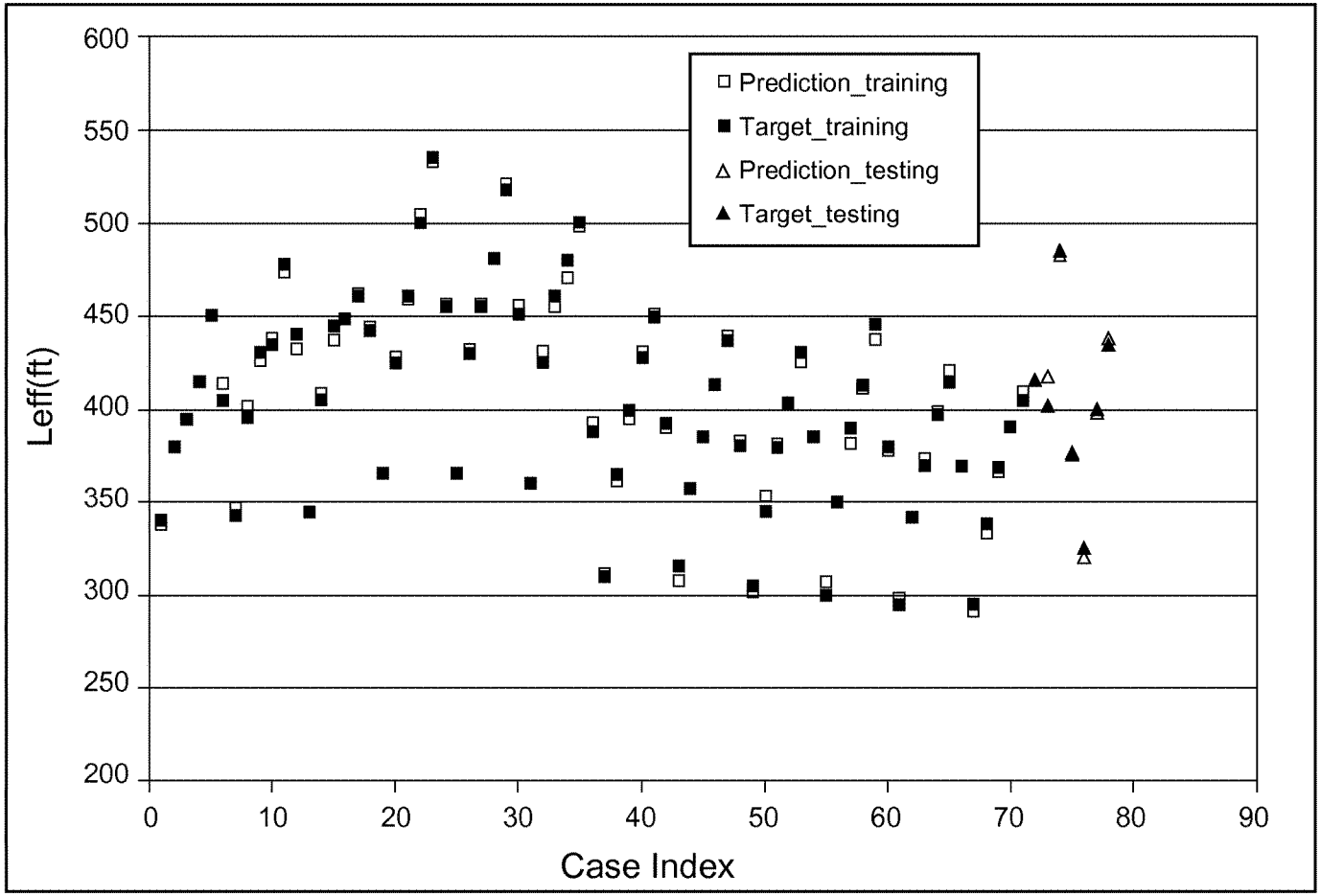
FIG. 5 is a plot showing target values and values predicted by a neural network, according to various embodiments.

FIG. 5 is a plot showing target values of $L_{eff}$ and values predicted by a neural network, according to various embodiments. The solid dots represent target values while hollow dots represent predictions. The square points are 70 training data points, while the triangle points are seven random testing cases.

The obtained neural network can be used to predict the hydraulic fracture dimensions and final vertical locations along the horizontal wellbore for any completion parameters specified by operators. This is one of the applications of the neural network.

Figure 6:
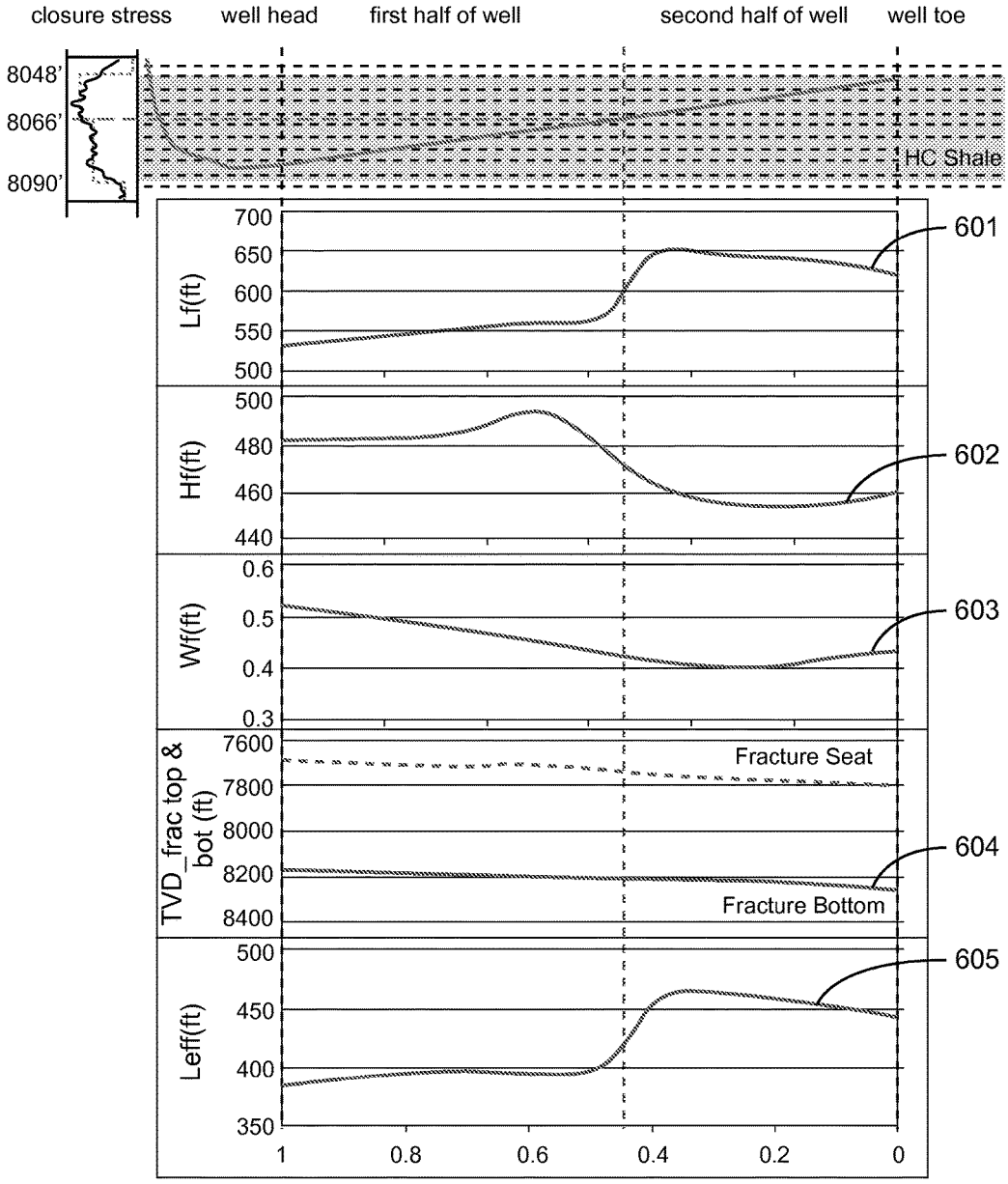
FIG. 6 is a plot showing fracture dimensions and locations predicted by the neural network for the whole lateral, according to various embodiments.

FIG. 6 is a plot showing fracture dimensions and locations predicted by the neural network for the whole lateral, according to various embodiments. In the example of FIG. 6, the slurry injection rate and the total injection volume for each stage are 48 bpm and 23 Mgal. Fracture length, height, width, TVD of the upper and lower fracture boundaries, and effective propped length are all calculated as a function of horizontal well distance (horizontal-vertical well correlation) by the previously trained neural network. The results are shown as solid lines 601-605 in different tracks of FIG. 6.

Another important application of the neural network is to optimize fracturing design through a massive parametric study. In the following optimization, effective propped length is taken as the optimization target.

Figure 7:
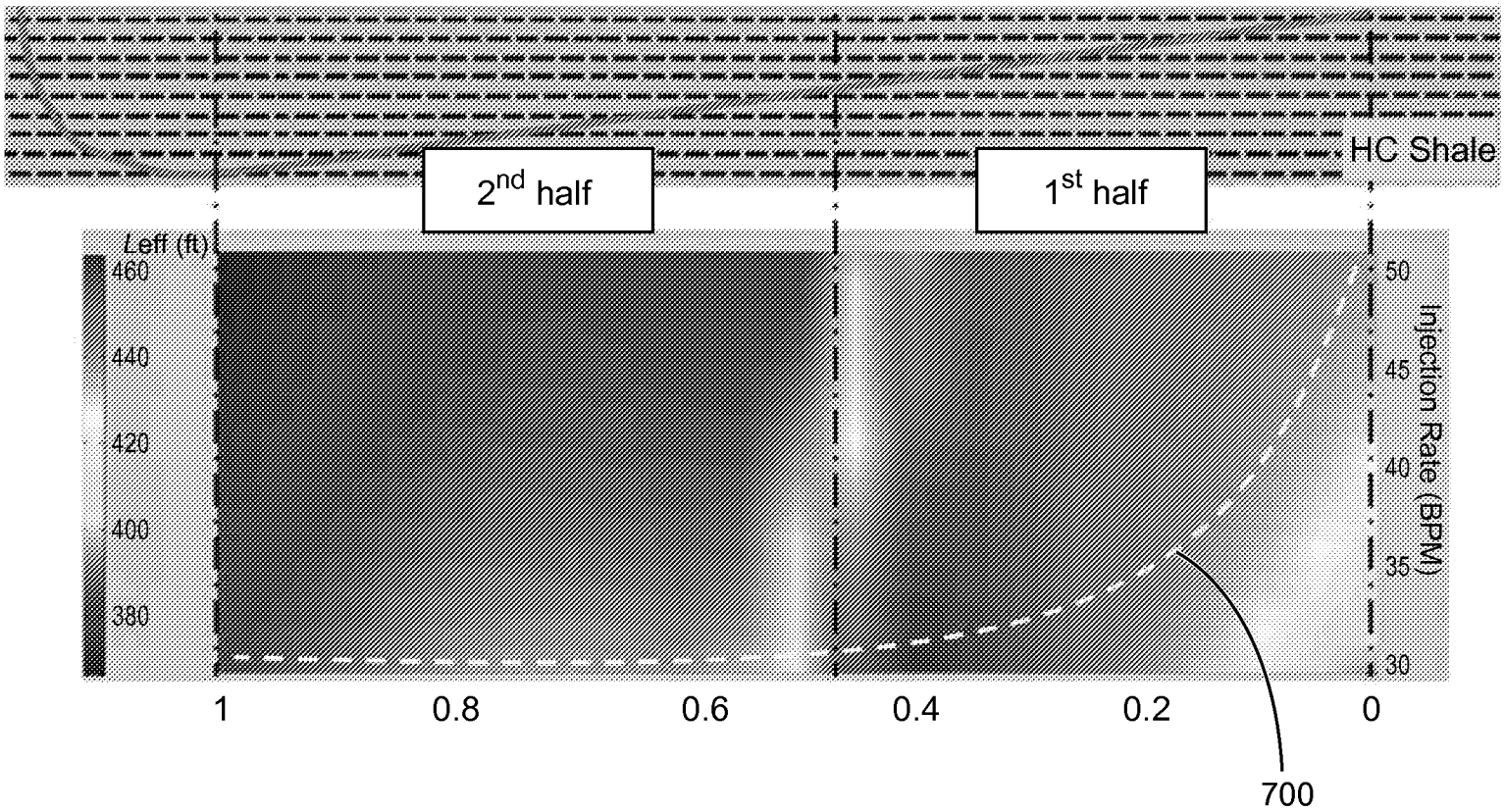
FIG. 7 is a plot showing fractures predicted by the neural network for the whole lateral at 20 Mgal/stg and varied injection rate, according to various embodiments.

FIG. 7 is a plot showing fractures predicted by the neural network for the whole lateral at 20 million gallons per stage (Mgal/stg) and varied injection rate, according to various embodiments. FIG. 7 illustrates how the effective propped length varies with perforation position and injection rate at a given injection volume of 20 Mgal/stg. It shows that the effective length is mainly controlled by the perforation position. $L_{eff}$ is 400-460 ft for the first half of the horizontal well, while 360-400 ft for the second half. Injection rate does not have much effect on the effective length. For positions from 0.2 to 1, lower injection rate produces a little longer length. Within the well tip part (<0.2), a reversed effect is observed. Based on the figure, optimal injection rate can be determined at different lateral position to yield the maximum $L_{eff}/v_{inj}$, which is shown as the dashed line 700.

Figure 8:
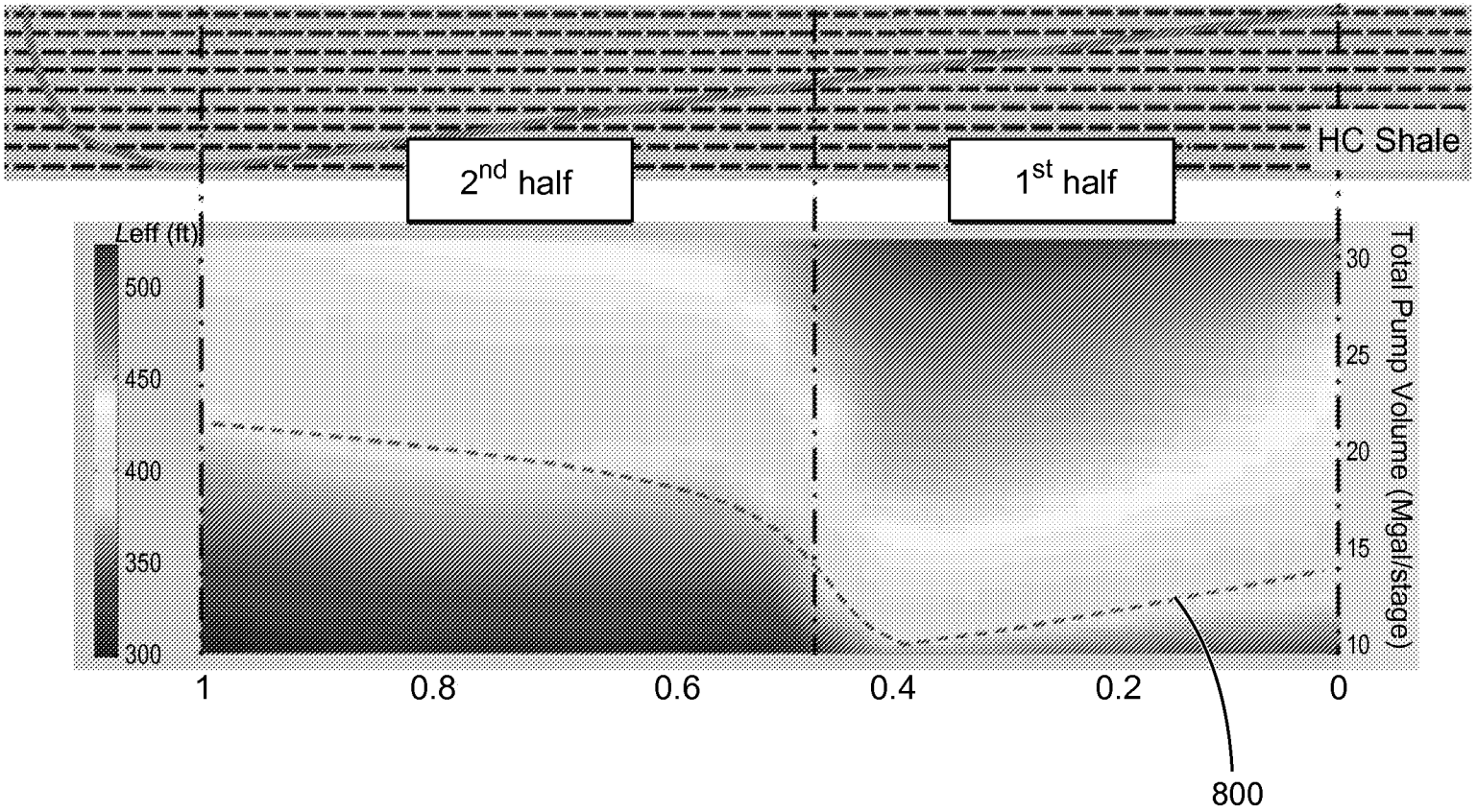
FIG. 8 is a plot showing fractures predicted by the neural network for the whole lateral at 40 BPM/stg and varied injection volume, according to various embodiments.

FIG. 8 is a plot showing fractures predicted by the neural network for the whole lateral at 40 BPM/stg and varied injection volume, according to various embodiments. FIG. 8 illustrates how the EPL varies with perforation position and injection volume at a given injection rate of 40 BPM/stg. To generate the same EPL, more slurry should be pumped for the second half of the horizontal well. For example, in order to produce 380 ft EPL 800, 10-15 Mgal would be pumped for the first half of the horizontal well and 15-20 Mgal for the second half. For a certain position, propped length increases with increasing pumping volume. Thus, an NPV study may be further included in order to decide the optimum pumping volume.

The results shown in FIG. 8 are combined with reservoir simulation to obtain an NPV map. In this example, the permeability and porosity of a shale gas reservoir are assumed to be 200 nD and 8%, respectively. The well is produced at a constant BHP and an initial drawdown of 3000 psi, fracture spacing is 100 ft, and gas price is assumed to be $4/Mscf. The treatment costs related to the slick water, pumping equipment and services have been bundled to be a value of $3/gal of slurry volume employed. By incorporating the parametric study results of FIG. 8 in a reservoir simulator, 1 Yr, 5 Yr and 20 Yr NPVs are generated as a function of perforation position and total pump volume per stage, as illustrated in FIG. 9.

Figure 9:
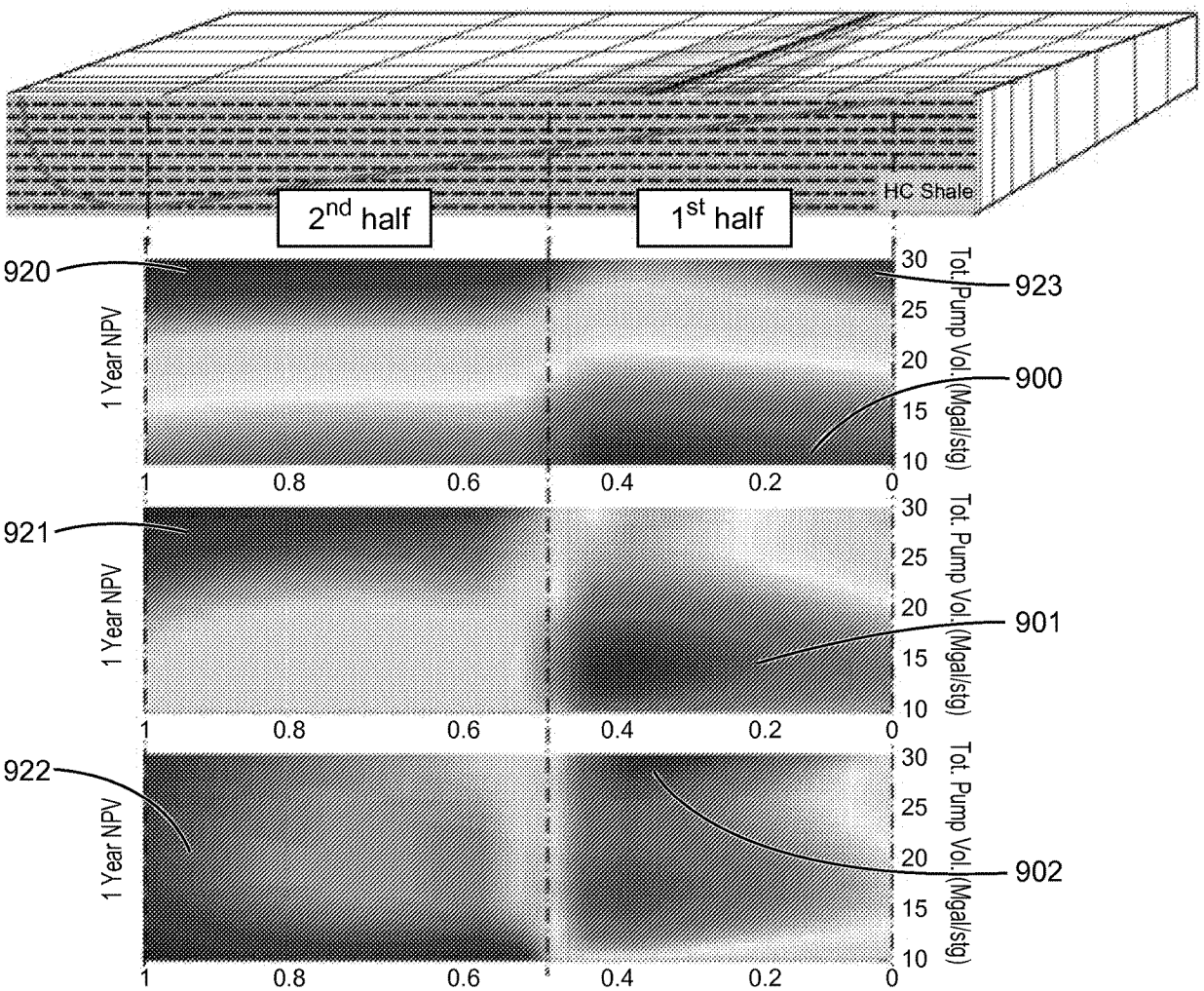
FIG. 9 is a plot showing 1, 5, and 20 year net present value (NPV) predicted by the neural network for the whole lateral at 40 BPM/stg and varied injection volume, according to various embodiments.

FIG. 9 is a plot showing 1, 5, and 20 year net present value (NPV) predicted by the neural network for the whole lateral at 40 BPM/stg and varied injection volume, according to various embodiments. In the contour maps, some of the darker shading 900-902 represent high NPV while other dark shading 920-923 represents low NPV. According to FIG. 9, optimal perforation locations and pump volumes can be determined based on the location of the sweet spots such as 900-902. In this example, the first half of the well yields better NPV than the second half for the same pumping volume. The discrepancy between the first and second half increases with production time. A different volume may be pumped to generate best NPV for different production periods. The optimal pump volume is 10-12 Mgal/stage for short production time (1 Yr), around 15 Mgal/stage for medium production time (5 Yr), and above 25 Mgal/stage for long production time (20 Yr).

Figure 10:
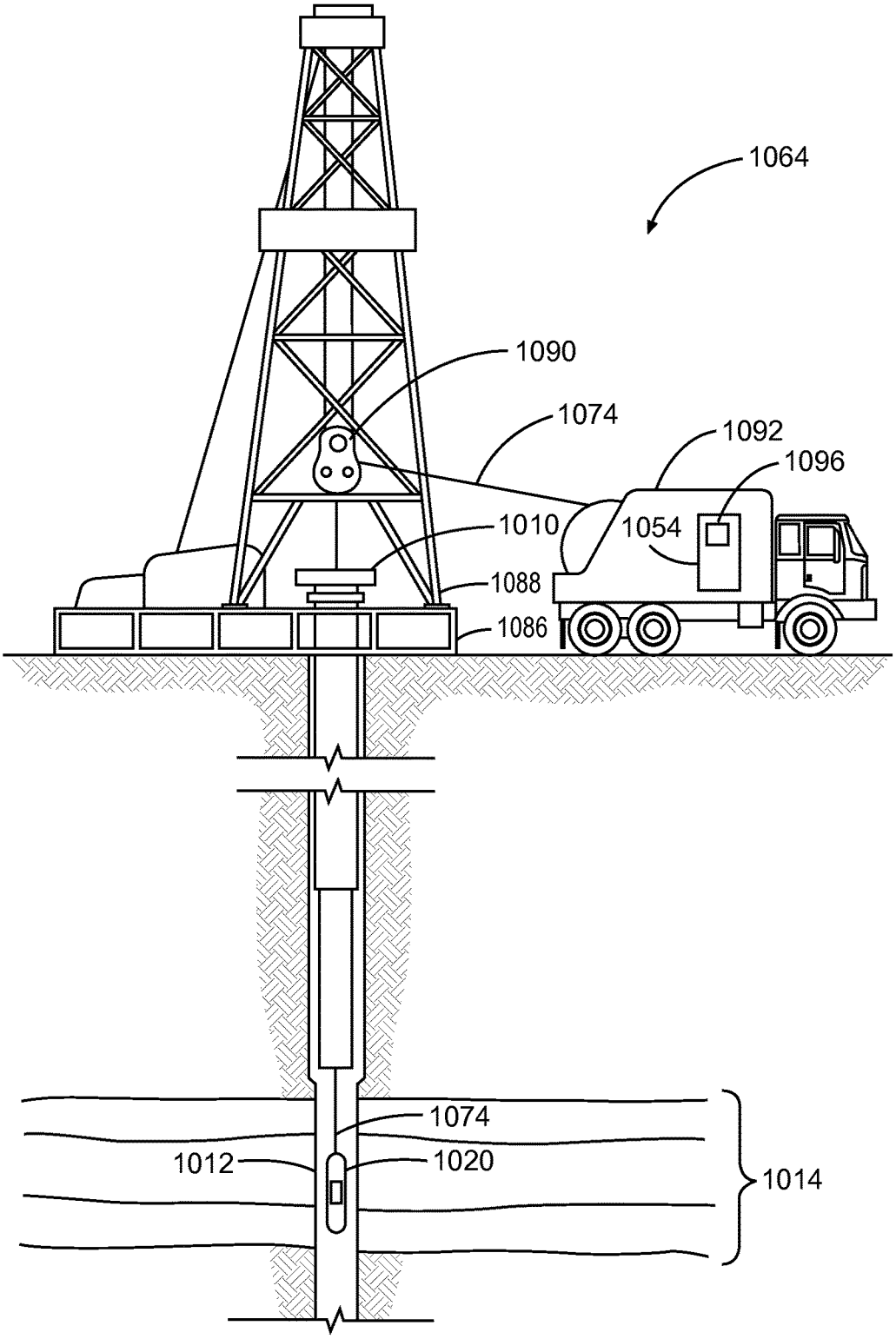
FIG. 10 is a diagram showing a wireline system, according to various embodiments.
Figure 11:
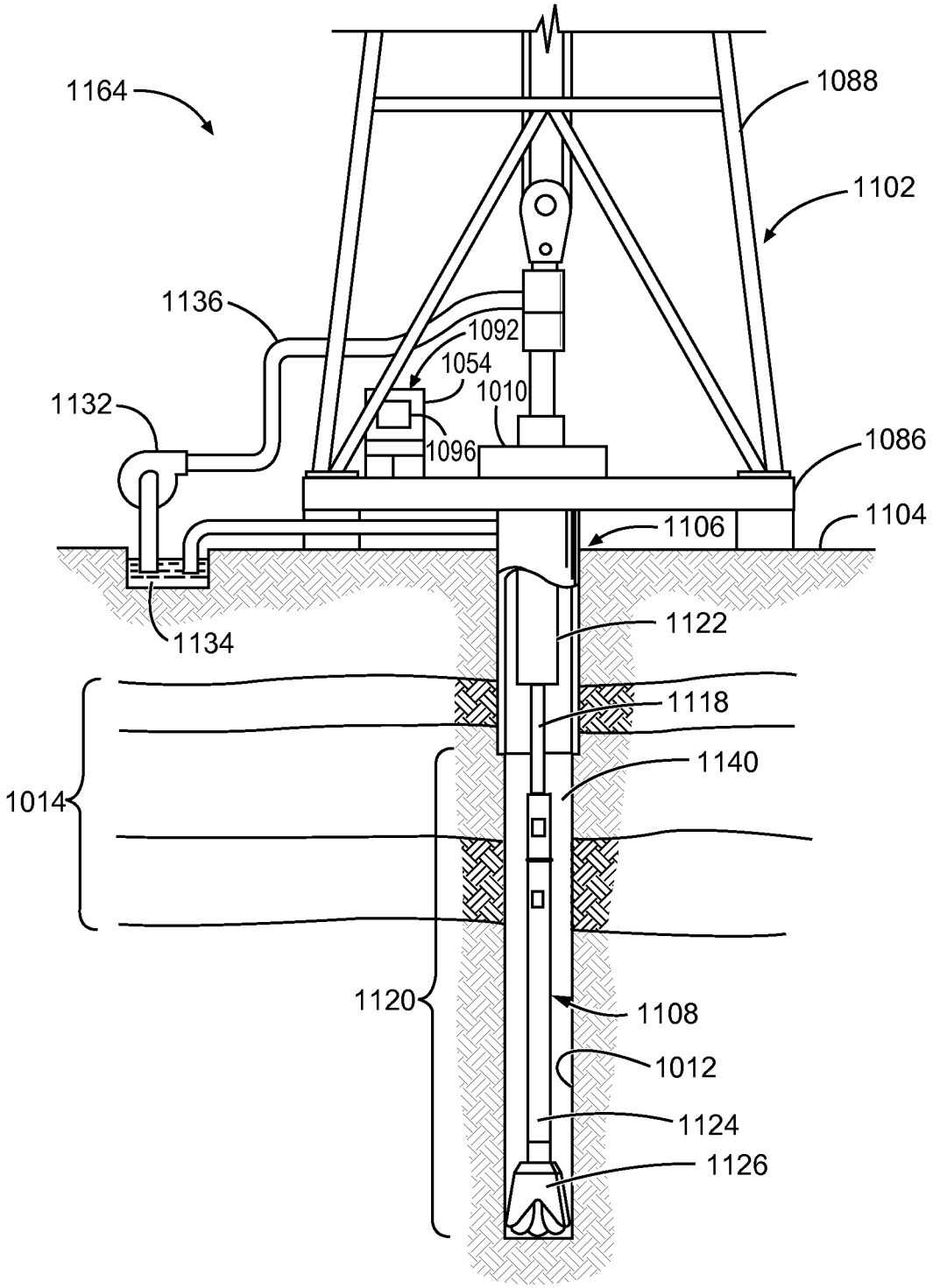
FIG. 11 is a diagram showing a drilling system, according to various embodiments.

FIG. 10 is a diagram showing a wireline system 1064 and FIG. 11 is a diagram showing a drilling system 1164, according to various embodiments. The systems 1064, 1164 may thus comprise portions of a wireline logging tool body 1020 as part of a wireline logging operation or of a downhole tool 1124 as part of a drilling operation. Either of these tools 1020, 1124 may include a tool (e.g., sonic tool) to provide the logging data used by the first step 100 of FIG. 1 as described previously.

FIG. 10 illustrates a drilling platform 1086 equipped with a derrick 1088 that supports a hoist 1090. Drilling oil and gas wells is commonly carried out using a string of drill pipes connected together so as to form a drillstring that is lowered through a rotary table 1010 into a wellbore or borehole 1012. Here it is assumed that the drillstring has been temporarily removed from the borehole 1012 to allow a wireline logging tool body 1020, including tools such as the sonic tool, to be lowered by wireline or logging cable 1074 (e.g., slickline cable) into the borehole 1012. Typically, the wireline logging tool body 1020 is lowered to the bottom of the region of interest and subsequently pulled upward at a substantially constant speed.

During the upward trip, at a series of depths various instruments may be used to perform geological formation measurements to produce wireline logging data. The wireline data may be communicated to a surface logging facility 1092 for processing, analysis, and/or storage. The logging facility 1092 may be provided with electronic equipment for various types of signal processing. Similar formation evaluation data may be gathered and analyzed during drilling operations (e.g., during LWD/MWD operations, and by extension, sampling while drilling).

In some embodiments, the tool body 1020 is suspended in the wellbore by a wireline cable 1074 that connects the tool to a surface control unit (e.g., comprising a workstation 1054). The tool may be deployed in the borehole 1012 on coiled tubing, jointed drill pipe, hard wired drill pipe, or any other suitable deployment technique.

Referring to FIG. 11, it can be seen how a system 1164 may also form a portion of a drilling rig 1102 located at the surface 1104 of a well 1106. The drilling rig 1102 may provide support for a drillstring 1108. The drillstring 1108 may operate to penetrate the rotary table 1010 for drilling the borehole 1012 through the subsurface formations 1014. The drillstring 1108 may include a drill pipe 1118 and a bottom hole assembly 1120 (e.g., drill string), perhaps located at the lower portion of the drill pipe 1118.

The bottom hole assembly 1120 may include drill collars 1122, a down hole tool 1124, including the sonic tool, and a drill bit 1126. The drill bit 1126 may operate to create the borehole 1012 by penetrating the surface 1104 and the subsurface formations 1014. The downhole tool 1124 may comprise any of a number of different types of tools including MWD tools, LWD tools, and others.

During drilling operations, the drillstring 1108 (perhaps including the drill pipe 1118 and the bottom hole assembly 1120) may be rotated by the rotary table 1010. Although not shown, in addition to, or alternatively, the bottom hole assembly 1120 may also be rotated by a motor (e.g., a mud motor) that is located down hole. The drill collars 1122 may be used to add weight to the drill bit 1126. The drill collars 1122 may also operate to stiffen the bottom hole assembly 1120, allowing the bottom hole assembly 1120 to transfer the added weight to the drill bit 1126, and in turn, to assist the drill bit 1126 in penetrating the surface 1104 and subsurface formations 1014.

During drilling operations, a mud pump 1132 may pump drilling fluid (sometimes known by those of ordinary skill in the art as "drilling mud") from a mud pit 1134 through a hose 1136 into the drill pipe 1118 and down to the drill bit 1126. The drilling fluid can flow out from the drill bit 1126 and be returned to the surface 1104 through an annular area 1140 between the drill pipe 1118 and the sides of the borehole 1012. The drilling fluid may then be returned to the mud pit 1134, where such fluid is filtered. In some embodiments, the drilling fluid can be used to cool the drill bit 1126, as well as to provide lubrication for the drill bit 1126 during drilling operations. Additionally, the drilling fluid may be used to remove subsurface formation cuttings created by operating the drill bit 1126. The borehole 1012 resulting from the drilling operation may be used for fracturing and perforation cluster placement in a shale deposit.

The workstation 1054 and the controller 1096 may include modules comprising hardware circuitry, a processor, and/or memory circuits that may store software program modules and objects, and/or firmware, and combinations thereof. The workstation 1054 and controller 1096 may be configured to create a density and energy spectrum map of the borehole cement.

In various embodiments, components of a system operable to perform shale fracturing characterization and optimization by using 3D fracture modeling and neural network, as described herein or in a similar manner, can be realized in combinations of hardware and/or processor executed software. These implementations can include a machine-readable storage device having machine-executable instructions, such as a computer-readable storage device having computer-executable instructions. Further, a computer-readable storage device may be a physical device that stores data represented by a physical structure within the device. Such a physical device is a non-transitory device. Examples of machine-readable storage devices can include, but are not limited to, read only memory (ROM), random access memory (RAM), a magnetic disk storage device, an optical storage device, a flash memory, and other electronic, magnetic, and/or optical memory devices.

Figure 12:
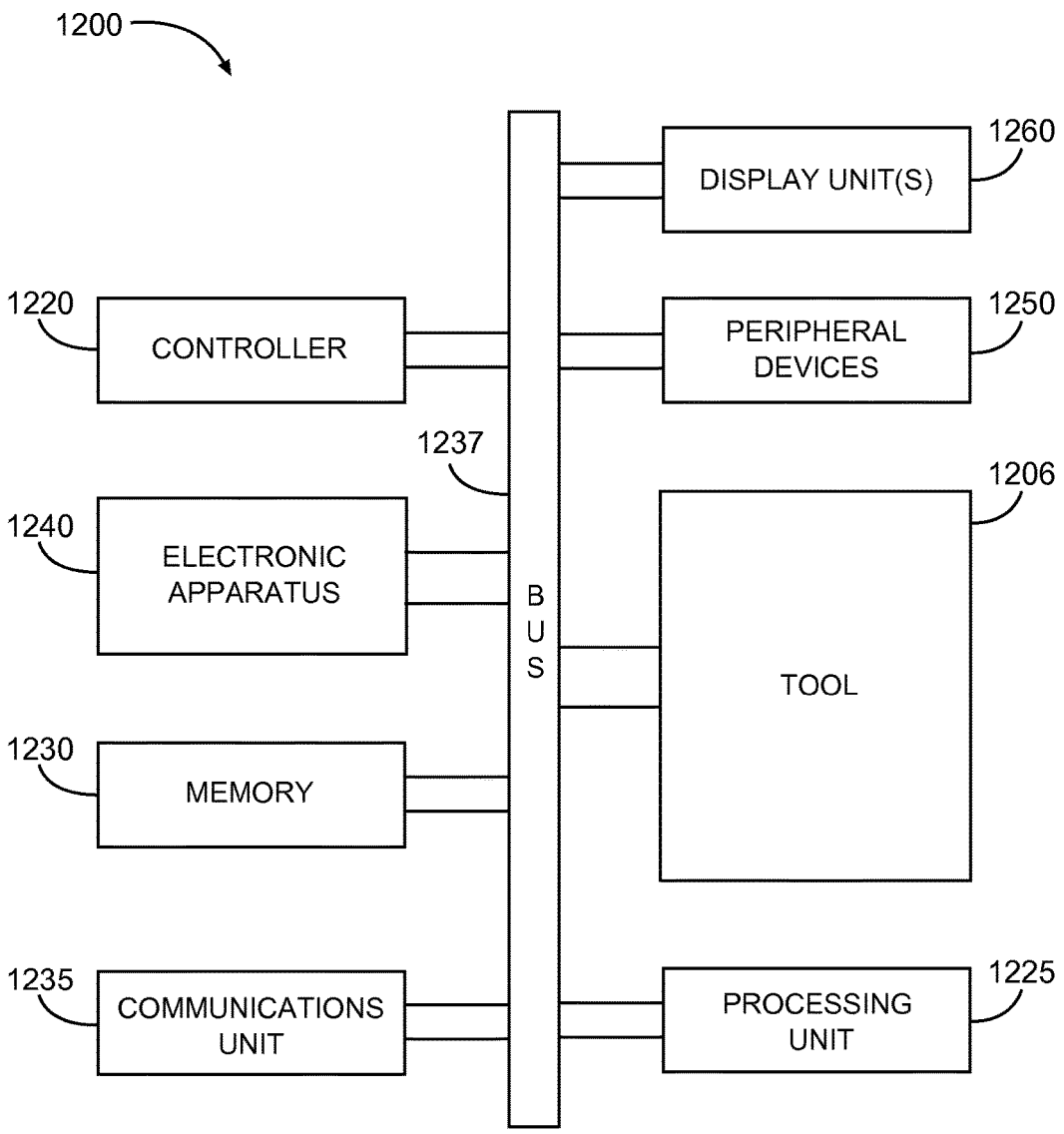
FIG. 12 is a block diagram of an example system 1200 operable to perform various methods, according to various embodiments.

FIG. 12 is a block diagram of an example system 1200 operable to perform various methods, according to various embodiments. The system 1200 may include a tool housing 1206 having a sonic tool.

The system 1200 may include a controller 1220, a memory 1230, an electronic apparatus 1240, and a communications unit 1235. The memory 1230 can be structured to include a database. The controller 1220, the memory 1230, and the communications unit 1235 can be arranged to operate as a processing unit to control operation of the system. A processing unit 1225 can be implemented as a single unit or distributed among the components of the system 1200 including electronic apparatus 1240. The electronic apparatus 1240 can provide other circuitry for operation of the system 1200. The controller 1220 and the memory 1230 can operate to manage processing schemes. The controller 1220, the memory 1230, and other components of the system 1200 can be configured, for example, to operate similar to or identical to the components discussed herein or similar to or identical to any of methods discussed herein.

The communications unit 1235 can include downhole communications for appropriately located sensors in a wellbore. Such downhole communications can include a telemetry system. The communications unit 1235 may use combinations of wired communication technologies and wireless technologies at frequencies that do not interfere with ongoing measurements.

The system 1200 can also include a bus 1237, where the bus 1237 provides electrical conductivity among the components of the system 1200. The bus 1237 can include an address bus, a data bus, and a control bus, each independently configured or in an integrated format. The bus 1237 can be realized using a number of different communication mediums that allows for the distribution of components of the system 1200. The bus 1237 can include a network. Use of the bus 1237 can be regulated by the controller 1220.

In various embodiments, the peripheral devices 1250 can include additional storage memory and other control devices that may operate in conjunction with the controller 1220 and the memory 1230. In an embodiment, the controller 1220 can be realized as a processor or a group of processors that may operate independently depending on an assigned function.

The system 1200 can include display unit(s) 1260 as a distributed component on the surface of a wellbore, which can be used with instructions stored in the memory 1230 to implement a user interface to monitor the operation of the tool 1206 or components distributed within the system 1200. The user interface may be used to input parameter values for thresholds such that the system 1200 can operate autonomously substantially without user intervention in a variety of applications. The user interface can also provide for manual override and change of control of the system 1200 to a user. Such a user interface can be operated in conjunction with the communications unit 1235 and the bus 1237.

As an example, the system 1200 may be operable to generate sonic data of a geological formation from a sonic tool in a borehole and determine, in response to the sonic data, a shale fracturing zone. The shale fracturing zone may be determined by determining horizontal and vertical dynamic elastic properties and anisotropic stress of a shale deposit in the geological formation. A training database may then be generated in response to fracture simulator modeling of variations of completion parameters slurry injection rate, total slurry volume, and/or perforation depth to generate output results: fracture length, fracture height, fracture width, fracture upper/lower boundary, and effective propped length. A neural network may be generated in response to the output results and perforation clusters installed along the borehole in response to the neural network.

Further examples include:

Example 1 is a method for shale fracturing comprising: determining dynamic elastic properties of a shale deposit in a geological formation; generating a training database by three-dimensional fracture modeling; generating a neural network in response to output results of the training database; and performing the shale fracturing based on the neural network.

In Example 2, the subject matter of Example 1 can further include wherein generating the training database comprises generating the output results at every depth along an interval to be fractured: fracture length, height, width, upper/lower boundary, and effective propped area and length of the shale deposit.

In Example 3, the subject matter of Examples 1-2 can further include wherein generating the effective propped area and length comprises generating the effective propped area and length for isotropic and anisotropic shale deposits for a plurality of completion parameters.

In Example 4, the subject matter of Examples 1-3 can further include wherein in performing the shale fracturing comprises predicting fracture geometry and location based on the fracture length, height, width and fracture upper/lower boundary.

In Example 5, the subject matter of Examples 1-4 can further include wherein performing the shale fracturing comprises determining a fracturing design by conducting a parametric study with the neural network.

In Example 6, the subject matter of Examples 1-5 can further include: testing the neural network to determine a tolerance error for all input parameters; and updating the neural network until the tolerance error is less than a predetermined threshold.

In Example 7, the subject matter of Examples 1-6 can further include wherein generating the training database comprises: inputting rock mechanical properties and closure stress into a fracture modeling simulator; varying completion parameters to generate the output results.

In Example 8, the subject matter of Examples 1-7 can further include wherein the completion parameters comprise slurry injection rate, total slurry volume, and perforation depth.

In Example 9, the subject matter of Examples 1-8 can further include wherein the parametric study comprises determining the effective propped length in response to: fracture conductivity/(propped fracture length*matrix permeability)>z where z is a constant.

Example 10 is a method for shale fracturing comprising: generating sonic data of a geological formation from a sonic tool in a borehole; determining, in response to the sonic data, a shale fracturing zone by: determining horizontal and vertical dynamic elastic properties and anisotropic stress of a shale deposit in the geological formation; generating a training database in response to fracture simulator modeling of variations of completion parameters slurry injection rate, total slurry volume, and/or perforation depth to generate output results: fracture length, fracture height, fracture width, fracture upper/lower boundary, and effective propped length; generating a neural network in response to the output results; and installing perforation clusters along the borehole in response to the neural network.

In Example 11, the subject matter of Example 10 can further include selecting hydraulic fracturing parameters to produce a largest effective propped area.

In Example 12, the subject matter of Examples 10-11 can further include selecting hydraulic fracturing parameters to produce a largest stimulated reservoir volume.

In Example 13, the subject matter of Examples 10-12 can further include wherein generating the sonic data comprises performing a wireline operation.

In Example 14, the subject matter of Examples 10-13 can further include wherein generating the sonic data comprises performing a drilling operation.

In Example 15, the subject matter of Examples 10-14 can further include wherein generating the training database comprises: varying each completion parameter by a plurality of respective values that are equally distributed within a predetermined range of values for the respective completion parameter; determining a relative error from the neural network for each completion parameter; and updating the neural network in response to the relative error.

In Example 16, the subject matter of Examples 10-15 can further include determining a critical conductivity to define the effective propped length, wherein the critical conductivity is a function of propped length, production time, matrix permeability, natural fracture properties, and/or oil specific weight.

Example 17 is a system comprising: a tool configured to generate sonic data representative of a geological formation; a controller configured to control fracturing of a shale deposit in the geological formation in response to the sonic data, the controller configured to: determine dynamic elastic properties of the shale deposit; generate a training database in response to fracture simulator modeling of variations of completion parameters slurry injection rate, total slurry volume, and/or perforation depth to generate output results: fracture length, fracture height, fracture width, and effective propped length; generate a neural network in response to the output results; and control the shale fracturing based on the neural network.

In Example 18, the subject matter of Example 17 can further include wherein the tool is a wireline tool.

In Example 19, the subject matter of Examples 17-18 can further include wherein the tool is a drill string tool.

In Example 20, the subject matter of Examples 17-19 can further include wherein the controller is further configured to update the neural network based on variations in the completion parameters.

Although specific embodiments have been illustrated and described herein, it will be appreciated by those of ordinary skill in the art that any arrangement that is calculated to achieve the same purpose may be substituted for the specific embodiments shown. Various embodiments use permutations and/or combinations of embodiments described herein. It is to be understood that the above description is intended to be illustrative, and not restrictive, and that the phraseology or terminology employed herein is for the purpose of description. Combinations of the above embodiments and other embodiments will be apparent to those of skill in the art upon studying the above description.

What is claimed is:

1. A method for shale fracturing comprising:

determining dynamic elastic properties of a shale deposit in a geological formation, based on sonic data from a sonic tool in a borehole within the geological formation;

generating a training database by three-dimensional fracture modeling of variations in completion parameters to generate output results for an interval of the geological formation to be fractured;

generating a neural network based on the output results of the training database;

performing a parametric study with the neural network to determine an effective propped length in response to: fracture conductivity/(propped fracture length*matrix permeability)>z, where z is a constant; and performing the shale fracturing using perforation clusters placed along the borehole, based on the effective propped length.

2. The method of claim 1, wherein the output results are selected from the group consisting of: fracture length, fracture height, fracture width, fracture upper/lower boundary, and effective propped area and length of the shale deposit.

3. The method of claim 2, wherein the effective propped area and length is generated for isotropic and anisotropic shale deposits for the completion parameters.

4. The method of claim 2, wherein in performing the shale fracturing further comprises predicting fracture geometry and location based on the fracture length, the fracture height, the fracture width and the fracture upper/lower boundary.

5. The method of claim 2, wherein performing the shale fracturing further comprises determining a fracturing design based on the parametric study with the neural network.

6. The method of claim 1, further comprising:

testing the neural network to determine a tolerance error for all input parameters; and updating the neural network until the tolerance error is less than a predetermined threshold.

7. The method of claim 1, wherein generating the training database comprises:

inputting rock mechanical properties and closure stress into a fracture modeling simulator; and varying the completion parameters to generate the output results.

8. The method of claim 7, wherein the completion parameters comprise slurry injection rate, total slurry volume, and perforation depth.

9. A method for shale fracturing comprising:

generating sonic data of a geological formation from a sonic tool in a borehole;

determining, in response to the sonic data, a shale fracturing zone by:

determining horizontal and vertical dynamic elastic properties and anisotropic stress of a shale deposit in the geological formation;

generating a training database in response to fracture simulator modeling of variations of completion parameters slurry injection rate, total slurry volume, and/or perforation depth to generate output results: fracture length, fracture height, fracture width, fracture upper/lower boundary, and effective propped area; and generating a neural network in response to the output results;

performing a parametric study with the neural network to determine an effective propped length in response to: fracture conductivity/(propped fracture length*matrix permeability)>z, where z is a constant; and installing perforation clusters along the borehole, based on the effective propped length.

10. The method of claim 9, further comprising selecting hydraulic fracturing parameters to produce a largest effective propped area.

11. The method of claim 9, further comprising selecting hydraulic fracturing parameters to produce a largest stimulated reservoir volume.

12. The method of claim 9, wherein generating the sonic data comprises performing a wireline operation.

13. The method of claim 9, wherein generating the sonic data comprises performing a drilling operation.

14. The method of claim 9, wherein generating the training database comprises:

varying each completion parameter by a plurality of respective values that are equally distributed within a predetermined range of values for the respective completion parameter;

determining a relative error from the neural network for each completion parameter; and updating the neural network in response to the relative error.

15. The method of claim 9, further comprising determining a critical conductivity to define the effective propped length, wherein the critical conductivity is a function of propped length, production time, matrix permeability, natural fracture properties, and/or oil specific weight.

16. A system comprising:

a tool to generate sonic data representative of a geological formation; and a controller to:

determine dynamic elastic properties of a shale deposit in the geological formation, based on the sonic data generated by the tool;

generate a training database in response to fracture simulator modeling of variations of completion parameters slurry injection rate, total slurry volume, and/or perforation depth to generate output results: fracture length, fracture height, fracture width, and effective propped length;

generate a neural network in response to the output results;

perform a parametric study with the neural network to determine an effective propped length in response to: fracture conductivity/(propped fracture length*matrix permeability)>z, where z is a constant; and control fracturing of the shale deposit based on the effective propped length.

17. The system of claim 16, wherein the tool is a wireline tool.

18. The system of claim 16 wherein the tool is a drill string tool.

19. The system of claim 16, wherein the controller is further configured to update the neural network based on variations in the completion parameters.

* * * * *